United States Patent [19]

Stevens et al.

[11] 4,177,937

[45] Dec. 11, 1979

[54] CONSTANT PRESSURE SPRAYING APPARATUS

[75] Inventors: Robert E. Stevens; Albert L. Schlensker, both of Westfield, Ind.

[73] Assignee: Curtis Dyna Products Corporation, Westfield, Ind.

[21] Appl. No.: 904,768

[22] Filed: May 11, 1978

[51] Int. Cl.[2] ..... F04B 49/08; F04B 49/06

[52] U.S. Cl. ..... 222/63; 222/318; 417/38; 417/435; 417/440

[58] Field of Search ..... 417/435, 440, 38, 44; 222/63, 318

[56] References Cited

U.S. PATENT DOCUMENTS

| | | | |
|---|---|---|---|
| 1,947,088 | 2/1934 | Johnson et al. | 222/318 |
| 2,309,339 | 1/1943 | Calaway | 417/440 |
| 2,858,964 | 11/1958 | North | 417/38 X |
| 3,430,577 | 3/1949 | Wagner | 417/440 |

*Primary Examiner*—Richard E. Gluck

*Attorney, Agent, or Firm*—Woodard, Weikart, Emhardt & Naughton

[57] ABSTRACT

Disclosed is a constant pressure spraying apparatus in which the motor driven pump piston moves within a pump housing and valve assembly which are carried by a cap or closure for the fluid tank forming the reservoir of fluid to be pumped and sprayed. The cap structure is shaped so as to provide a drain sump for fluid leaking past the pump piston.

5 Claims, 4 Drawing Figures

CONSTANT PRESSURE SPRAYING APPARATUS

BACKGROUND OF THE INVENTION

Pressure sprayers of the relatively small, portable type have long been in use for spraying fruit trees, spraying insecticide in interiors (around baseboards, for example), spraying germicides for disinfecting hospital rooms and the like. These spraying devices have been of the manual, pneumatic type in which a hand-pump, incorporated in the structure is manually reciprocated, at the start of a spraying run, to build up an air pressure above the liquid in the tank sufficient to force liquid from the tank and through the spray nozzle. A difficulty with this mode of operation, aside from the inconvenience and tiring effect of the necessary manual working of the pump at the start of each spray session is that the pressure falls off as spraying proceeds varying the discharge and the operator has only very poor control over how much material, such as insecticide is deposited during the spraying operation.

The spraying apparatus of the present invention utilizes a pump, operated by a battery powered motor controlled by a pressure switch to provide a constant spraying pressure, giving a constant discharge and providing the operator with excellent control of the quantity of material deposited by the spraying operation. The spray nozzle is conventionally provided with a manually operated valve which is used for intermittant spraying. When the manual, spray-control valve is off, the pressure switch, because of the resulting rise in pressure in the discharge line, immediately deenergizes the pump motor. Battery energy is thus saved and there is no necessity for an electrical connection to the spray wand or spray valve. Manually opening the spray control valve lowers the pressure in the discharge line and the pump motor immediately restarts. With the motor switch remaining closed, control of the pump motor is thus accomplished without electric wiring into the liquid carrying spray wand or valve, thus avoiding obvious electrical hazard.

DESCRIPTION OF THE PREFERRED EMBODIMENTS

Figure 1:
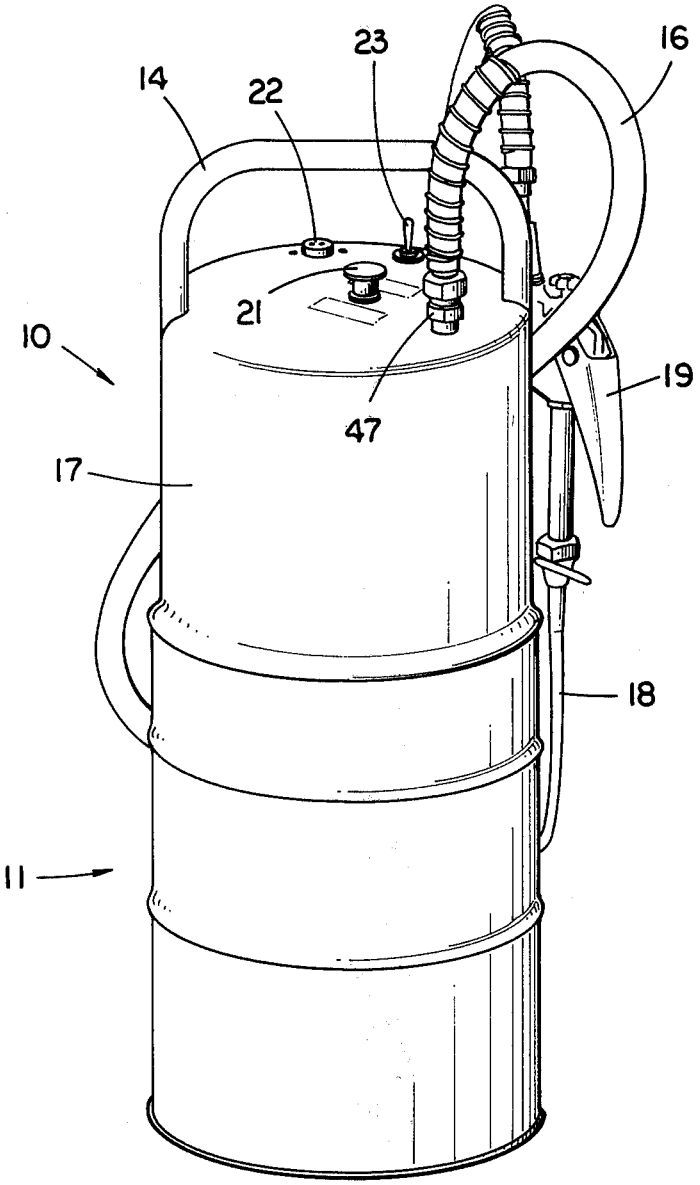
FIG. 1 is a perspective view of a spraying apparatus incorporating the pumping assembly of the present invention.

Referring initially to FIG. 1, there is disclosed a constant pressure spraying apparatus which includes a pumping head generally indicated at 10 and a reservoir tank of liquid to be sprayed indicated generally at 11. The head assembly fits over the upper end of the tank 11 and, as may be seen in FIG. 2, an internally threaded flange 12, with the aid of a gasket 13, may be screwed down on a threaded aperture at the top of the tank 11. To aid in positioning the head, it is provided with a handle 14. A conventional flexible discharge hose 16 extends from a fitting 47 in the top of the closure cap 17, the hose 16 terminating at the manually controlled spray nozzle 18, the nozzle being controlled by means of the squeeze-handle 19. It will be understood that the hose and its attached spray nozzle are conventional.

Figure 2:
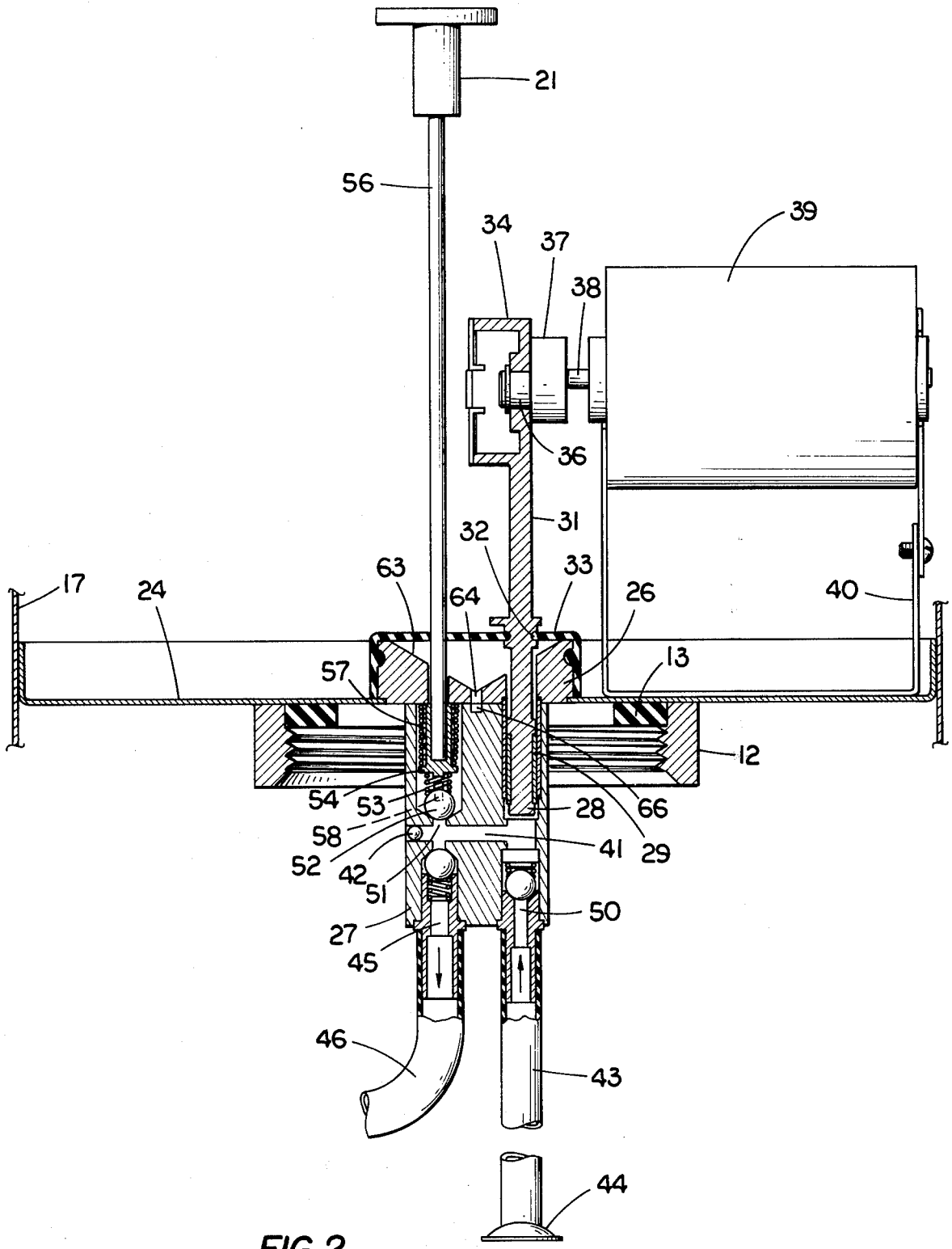
FIG. 2 is a side, sectional view of the pump assembly.

There further extends from the top of the cap 17 a priming knob 21, an electrical receptacle 22 and a control toggle switch 23. Referring to FIG. 2, the pumping assembly includes a dish-shaped base plate 24 which fits tightly against the adjacent cap 17. A central aperture in the base plate is closed by a closure member 26, which may be formed of brass. Extending from the closure member and from the underface of the plate 24 is a flow control body 27, the body 27 and the closure 26 being rigidly joined together.

The control body 27 is provided with a piston bore 28 into which a piston 29 extends. The piston 29 is rigidly connected to a piston rod or crank arm 31 which extends upwardly from the closure member 26 and is sealed at 32 to a flexible cap 33 which encloses the upper portion of the closure member 26. The rod 31 terminates at its upper end in a member 34 which receives a stub shaft 36, the member 34 being free to rotate with relation to the shaft 36. The shaft 36 is carried by an eccentric member 37, which is rigidly mounted on a motor shaft 38 rotated by motor 39. The motor 39 is supported by a bracket 40 attached to the base plate 24.

Figure 3:
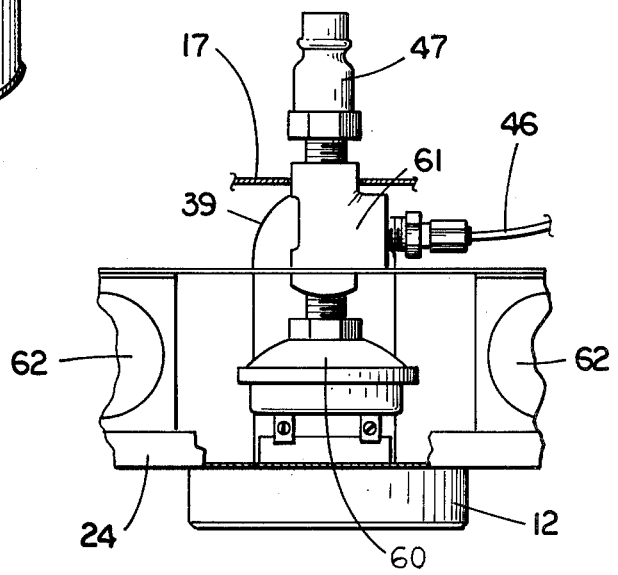
FIG. 3 is a fragmentary, side view of the pump motor control of the present invention.

The body 27 is provided with a transverse passage 41 closed by the stationary sealing ball 42. The passage 41 communicates with the space adjacent the working face of the piston 28 and with a ball-check valve controlled suction passage 50, the suction passage communicating with a flexible hose 43 which extends to a suitable screening foot 44 adjacent the bottom of the tank 11 when the assembly is installed in position on the tank. The passage 41 also communicates with a ball-check valve controlled discharge line 45. The discharge passage 45 communicates with a flexible discharge hose 46 which extends to and is attached to the underportion of the fitting 47 (FIG. 1) to which the hose 16 is attached. Directly above the discharge passage 45 and also communicating with the passage 41 is a by-pass passage 51 which is closed by a ball closure 52. A light compression spring 53 bottoms against the ball and extends to a shoulder in the lower end 54 of a priming rod 56 which, at its upper end carries the priming knob 21. A relatively strong compression spring 57 biases the rod end 54 downwardly against the ball 52 locking it in closed position against the seat at the mouth of the passage 51. The rod 56 is shown in upward or priming position and in this position liquid pressure in the passage 43 can move the ball 52 off its seat permitting fluid to flow past the ball and through the small rectangular passage 58 in the side of the body 27. The passage 58 extends through the side of the body 57 and thereby directs liquid moving past the ball 52 back to the underlying tank-reservoir of liquid. It will be understood that when priming rod 56 is released, so that spring 57 may return to its downward position, the ball 52 will be locked against its seat closing the by-pass passage 51. The priming shaft 56 extends freely through the resilient cap 33 and freely through an aperture in the member 26. The flexible tubing 46 also passes upwardly through a recessed portion of the member 26 and through the resilient cap 33 (behind rod 56 and therefore not visible in FIG. 2) to a T-fitting 61 (FIG. 3), the upwardly directed end of the fitting being attached to the fitting 47 which receives the hose 16.

The lower end of the fitting 61 communicates with a conventional pressure switch 60 which controls energization of the motor 39. The pressure switch may be set to operate so as to provide pumping action of the motor to maintain the desired delivery pressure from the pump, and a convenient pressure value for insecticide applications has been found to be 20 pounds per square inch. The source of power for the motor 39 is composed of dual, sealed, lead-acid batteries 62 (FIG. 3), the pressure switch 60 controlling the energizing circuit to the motor 39. The batteries 62 are rechargeable and the receptacle 22 (FIG. 1) receives a plug portion (not shown) of a conventional charging regulator which may be plugged into a conventional 110-volt AC outlet. To facilitate use of the conventional charger attachment (not shown) the toggle switch 23 is preferrably a three position toggle, the toggle member in upright position as shown in FIG. 1 breaking the circuit both to the motor 39 (the "off" position) but permitting charging current to flow to the batteries 62 assuming the charging regulator is plugged into a 110-volt source. When deflected to one side, the rapid charging mode of the charger is placed in circuit with the batteries and rapid charging takes place. When deflected to the opposite side (the "on" position) the circuit between the motor 39 and the batteries 62 is closed and pumping action occurs.

In operation, when the switch 23 is moved to the "on" position, the motor 39 will be energized and pumping action will start. The priming knob 21 is pulled outwardly to its position of FIG. 2 at start-up and the action of the piston 28 will pump liquid from the tank through the tubing 43 and into the chamber 41 where its pressure will overcome the force of the light spring 53, moving fluid past the ball 52 and through the by-pass aperture 58 back to the tank. As soon as this priming action is completed the priming knob 21 may be released causing the member 54 to hold the ball 52 against its seat closing off the by-pass. Liquid will then be delivered under pressure to the passage 45 by overcoming the check valve and will flow to the hose 16. When the pressure reaches the control value for the pressure switch 60, the motor 39 will be de-energized. Operation of the spraying nozzle 18 will cause the motor 39 to cycle on and off to maintain a uniform pressure (preferrably 20 pounds per square inch) in the discharge line. The spraying operation may thus take place with a constant pressure delivery of fluid through the spray nozzle.

It will be noted that the upper face of the member 26 has a conically concave configuration as indicated at 63 and has a drain aperture 64 at its lowermost point. The drain aperture communicates with a radial passage 66 in the member 27 and this passage 66 opens to the side of the member 27 permitting fluid in the passage 66 to drain back to the underlying reservoir tank 11. This arrangement assures that any liquid moving upwardly past the piston 28 will drain down the concave surface 63, through the aperture 32 and the passage 66 back to the reservoir tank. Any leakage of the piston is thus harmlessly drained back into the reservoir.

Figure 4:
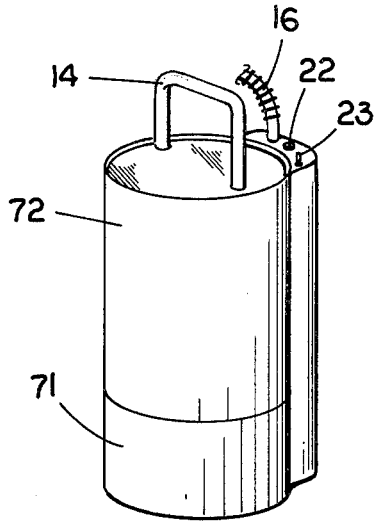
FIG. 4 is a perspective view of a modified form of the pumping assembly of the present invention.

Referring to FIG. 4, there is shown a modified form of the apparatus which differs from that previously described primarily in the arrangement of the pumping assembly 71 below the reservoir tank 72. These components are reversed in relative position as compared with the structures 10 and 11 of FIG. 1. With this arrangement the discharge fitting, the receptacle 22 and the switch 23 are all mounted at the upper face of the tank in a separate adjacent housing. This arrangement has utility in that liquid from the reservoir tank 72 may flow by gravity to the pump suction passage and no priming apparatus is necessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A constant pressure pumping assembly adapted to be mounted on one wall of a tank containing a liquid to be pumped from the tank, said assembly comprising a base plate, a flow control body extending from one face of said base plate into said tank, a pump piston extending into a piston bore in said control body, an electric motor and a pump discharge pressure responsive switch controlling the motor both mounted on said base plate, motion transmission means between said motor and piston whereby when said motor is energized said piston is reciprocated in said bore to provide a positive displacement pump, check valve controlled suction and discharge passages in said control body communicating with the space adjacent the working face of the piston, a by-pass passage communicating with said space and with the interior of the tank, a priming member for blocking said by-pass passage when in operating position and opening said by-pass passage when in priming position, a closure member for said flow control body overlying said body and extending from the other face of said base plate, the outer surface of the closure member having a concave configuration with a drain aperture at its lowermost point, said piston bore intersecting said concave surface whereby fluid leakage past said piston is directed by said concave surface into said drain aperture.

2. An assembly as claimed in claim 1 in which said motion transmission means includes a piston rod connected to said piston and connected to an eccentric member rotated by said motor.

3. An assembly as claimed in claim 2 in which a flexible cap overlies said concave surface of the closure member, said piston rod extending through and sealed to said cap, the flexibility of said cap accomodating the motion of said piston rod.

4. An assembly as claimed in claim 1 in which a liquid passage from said drain aperture communicates with the interior of said tank.

5. An assembly as claimed in claim 1 in which said base plate has a threaded flange depending therefrom and concentric with said flow control body, said threaded flange being adapted to cooperate with a threaded aperture in the top of said tank.

* * * * *